US006135761A

United States Patent [19]

Chen

[11] Patent Number: 6,135,761

[45] Date of Patent: Oct. 24, 2000

[54] SAFETY ARRANGEMENT FOR PIEZOELECTRIC LIGHTER

[76] Inventor: Peter Chen, 16134 E. Ridge View, La Mirada, Calif. 90638

[21] Appl. No.: 09/454,833

[22] Filed: Dec. 6, 1999

[51] Int. Cl.[7] ..... F23Q 2/28

[52] U.S. Cl. ..... 431/132; 431/153

[58] Field of Search ..... 431/129–141, 431/153, 255

[56] References Cited

U.S. PATENT DOCUMENTS

| | | | |
|---|---|---|---|
| 4,904,180 | 2/1990 | Nitta | 431/153 |
| 5,310,336 | 5/1994 | Segawa | 431/132 |
| 5,462,432 | 10/1995 | Kim | 431/153 |
| 5,531,591 | 7/1996 | Yamazaki | 431/153 |

*Primary Examiner*—Ira S. Lazarus
*Assistant Examiner*—Sara Clarke
*Attorney, Agent, or Firm*—Raymond Y. Chan; David and Raymond

[57] ABSTRACT

A piezoelectric lighter incorporates with a safety arrangement which includes an ignition cap slidably mounted on the ceiling of the casing in a radially movable manner, wherein the ignition cap is attached to a top end of the piezoelectric unit. A locker cavity is provided at a side portion of the ignition cap wherein an elongated guiding slot is provided on the ignition cap to communicate the locker cavity with outside. A locking member includes a locking latch slidably fitted in the locker cavity in a vertically movable manner and a operation button extended from the locking latch to outside through the guiding slot, and a resilient element disposed in the locker cavity and provided between the locking member and a ceiling of the locker cavity for urging and retaining the locking member in a lower position that a bottom end of the locking latch is extended into the casing for blocking up the ignition cap from being slid sidewardly from the casing so as to lock up the ignition cap from ignition. In order to ignite the lighter, a user's thumb must push the operation button upwardly for lifting up the locking latch out of the casing. Then, push the ignition cap sidewardly to depress the piezoelectric to ignite the lighter.

25 Claims, 5 Drawing Sheets

SAFETY ARRANGEMENT FOR PIEZOELECTRIC LIGHTER

BACKGROUND OF THE PRESENT INVENTION

1. Field of the Invention

The present invention relates to a piezoelectric lighter, and more particularly to a safety arrangement for piezoelectric lighter wherein the safety arrangement normally locks the ignition cap of the piezoelectric lighter so as to prevent the piezoelectric lighter from being ignited accidentally or by children.

2. Description of Related Arts

Piezoelectric lighters have been known and sold throughout the United States. The conventional push-down type piezoelectric lighter generally comprises a cap which covers on top of the lighter. In order to ignite the lighter, a user must open the cap and downwardly depress an ignition button. The cap can prevent the lighter from being ignited accidentally. However, it cannot stop children from the usage of the piezoelectric lighter.

To solve the drawbacks set forth above, the push-down type piezoelectric lighter may employ a safety switch to normally lock up the downwardly movement of the ignition button so as to prevent the depression of the ignition button. However, for some other slide-down type piezoelectric lighters, which ignition button must be pushed sidewardly and downwardly at the same time for ignition, the conventional safety switch which is designed for locking up the downwardly ignition button can not fit the structure of such slide-down type piezoelectric lighter. In fact, there is no existing safety arrangement can effectively and economically fit the slide-down type piezoelectric lighter. Since both the government and the consumers in United States demand a safety device employed in every lighter to prevent unwanted ignition accidentally or by a child, such unprotected slide-down type piezoelectric lighters are generally not allowed to marketing in United States.

SUMMARY OF THE PRESENT INVENTION

A main object of the present invention is to provide a safety arrangement for piezoelectric lighter which can prevent the lighter from being ignited accidentally or by children.

Another object of the present invention is to provide a safety arrangement for piezoelectric lighter that normally locks up the slide-down ignition motion of the pusher cap so as to prevent any unwanted ignition of the lighter.

Another object of the present invention is to provide a safety arrangement for piezoelectric lighter, wherein in order to depress the ignition cap sidewardly and downwardly so as to ignite the lighter, the user must push up an operation button and remain its up-pushing position. Therefore, children under five years old are unable to complete the igniting operation.

Another object of the present invention is to provide a safety arrangement for piezoelectric lighter which not only normally retains in a locking condition, but also can automatically return to the locking condition after each ignition operation so as to prevent any unintentional ignition of the lighter.

In order to accomplish the above objects, the present invention provides a safety arrangement for a piezoelectric lighter which comprises:

a casing receiving a liquefied gas storage;

a gas emitting nozzle appearing at a ceiling of the casing and communicating with the liquefied gas storage for controlling the flow of gas;

a piezoelectric unit, which is disposed in the casing for generating piezoelectricity, comprising a movable operating part extended upwardly and an ignition tip extended to a position closed with the gas emitting nozzle, wherein when the movable operating part is depressed downwardly, the ignition tip generates sparks to ignite the gas emitted from the gas emitting nozzle at the same time; and an ignition cap slidably mounted on the ceiling of the casing in a radially movable manner wherein the ignition cap is attached to a top end of the piezoelectric unit and arranged in such a manner that when the ignition cap is depressed sidewardly and downwardly at the same time, the movable operating part of the piezoelectric unit is depressed to ignite the piezoelectric lighter.

The safety arrangement comprises:

a locker cavity provided at a side portion of the ignition cap and positioned above the piezoelectric unit, wherein a guiding slot is provided on the ignition cap to communicate the locker cavity with outside;

a locking member comprising a locking latch disposed in the locker cavity and an operation button extended from the locking latch to outside through the guiding slot, wherein the locking latch is movably fitted in the locker cavity in such a manner that the locking latch is arranged to be driven by the operation button to move from a normally locking position to an unlocked position; and a resilient element which is disposed in the locker cavity for applying an urging pressure against the locking member so as to normally retain the locking member at the locking position, wherein at the locking position, a locking portion of the locking latch is extended into the casing for blocking up the ignition cap from being slid sidewardly with respect to the casing so as to lock up the ignition cap from ignition, and that at the unlocked position, the locking portion of the locking latch is moved away from the casing so as to release the blocking up of the ignition cap with respect to the casing, so that the ignition cap is capable of being slid sidewardly to ignite the piezoelectric lighter.

In order to ignite the piezoelectric lighter, a user's thumb must intentionally push up the operation button to drive the locking latch to move an upper unlock position where the bottom end of the locking latch is upwardly moved out of the casing. Then, the user can depress the ignition sidewardly and downwardly while remaining the locking latch in such upper unlock position to ignite the piezoelectric lighter. After every ignition operation as mentioned above, the ignition cap automatically returns to its original position and, at the same time, the resilient element will automatically rebound the locking member downwardly to lock up the ignition cap with a ceiling wall of the casing once the pushing force applied by the user's thumb is released.

DETAILED DESCRIPTION OF THE PREFERRED EMBODIMENT

Figure 1:
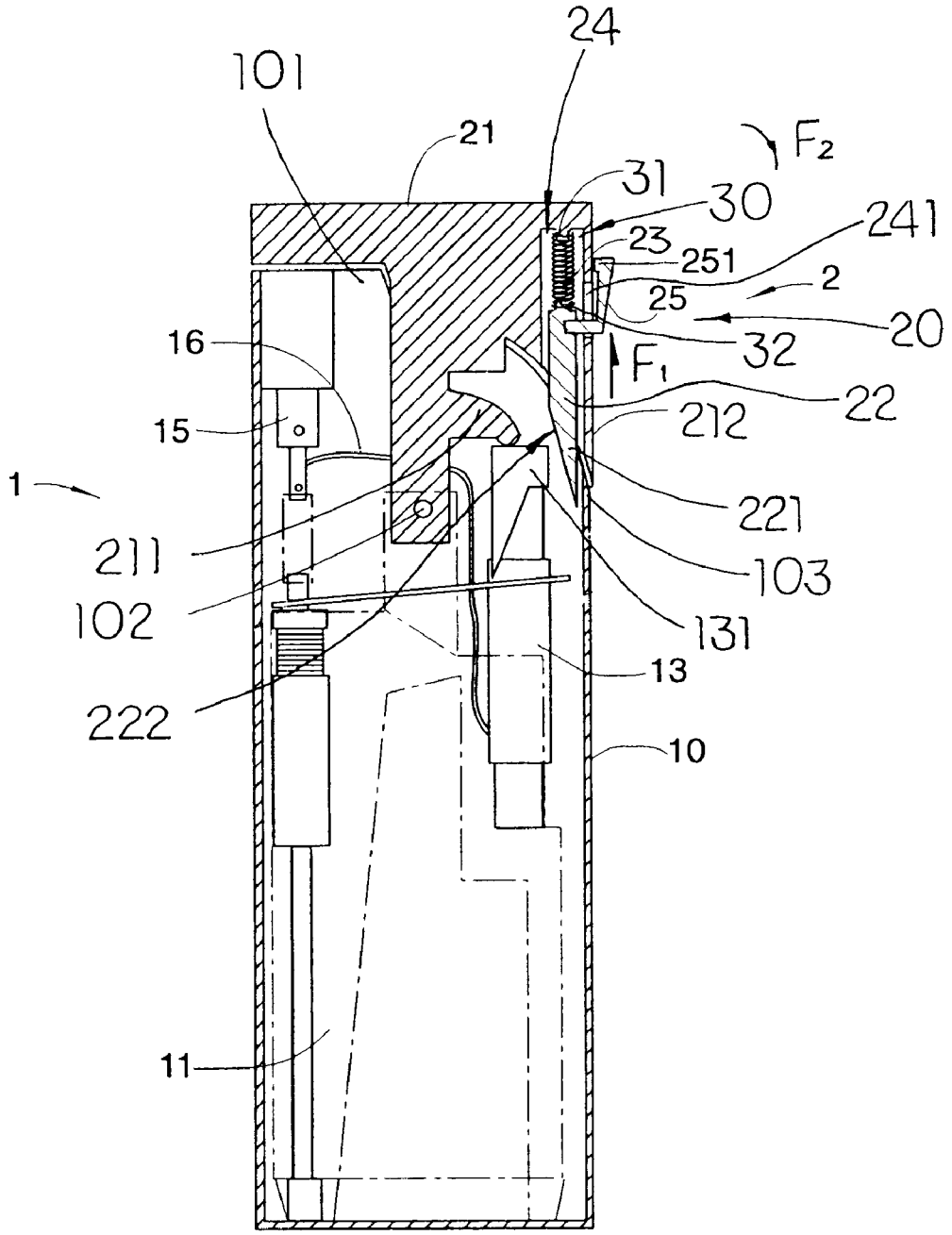
FIG. 1 is a partially sectional view of a piezoelectric lighter employed with a safety arrangement, during a locking condition, according to a preferred embodiment of the present invention.

Referring to FIG. 1 of the drawing, a piezoelectric lighter 1 equipped with a safety arrangement 2 according to a preferred embodiment of the present invention is illustrated. The piezoelectric lighter 1, such as a standard piezoelectric lighter, comprises a casing 10 having a liquefied gas storage 11, a gas emitting nozzle 15 appearing from a ceiling of the casing 10 and communicating with the liquefied gas storage 11 for controlling the flow of gas.

A piezoelectric unit 13, which is disposed in the casing 10 for generating piezoelectricity, comprises a movable operating part 131 extended upwardly, and an ignition tip 16 extended to a position closed with the gas emitting nozzle 15, wherein when the movable operating part 131 is depressed downwardly, sparks is generated from the ignition tip 16 to ignite the gas emitted from the gas emitting nozzle 15 at the same time.

An ignition cap 21 slidably mounted on a ceiling 101 of the casing 10 in a radially movable manner about an operation axle 102 provided in the casing 10, wherein the ignition cap 21 has a depressing arm 211 extended to rest on top of the movable operating part 131 of the piezoelectric unit 13 and arranged in such a manner that when the ignition cap 21 is depressed sidewardly and downwardly at the same time, the depressing arm 211 will be driven to downwardly to depress the movable operating part 131 of the piezoelectric unit 13 to ignite the piezoelectric lighter 1.

The piezoelectric lighter further comprises a safety arrangement 2 which comprises a locker cavity 24, a locking member 20, and a resilient element 23.

Figure 3:
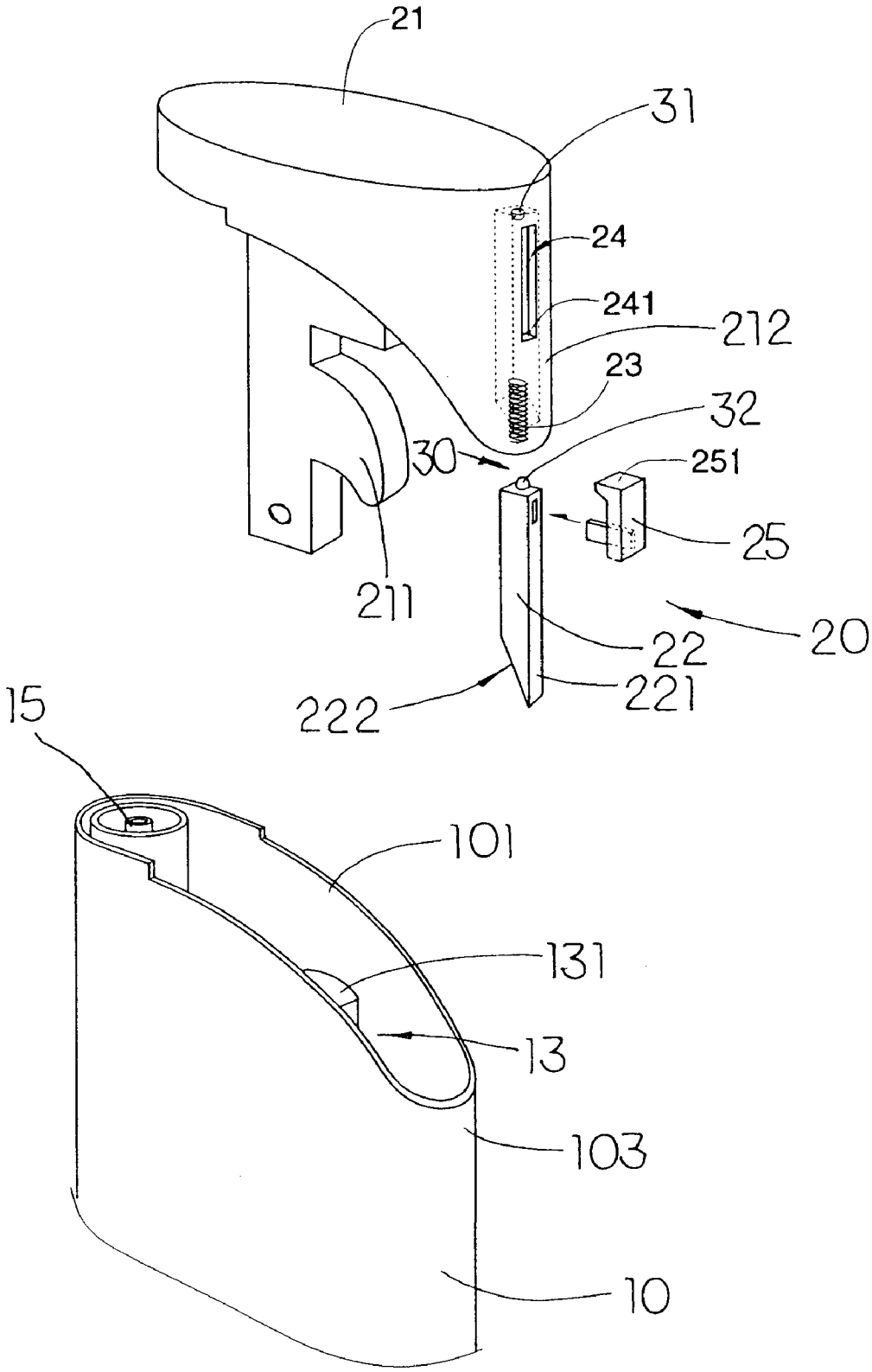
FIG. 3 is a partially exposed perspective view illustrating the safety arrangement for the piezoelectric lighter according to the above preferred embodiment of the present invention.

Referring to FIG. 3 of the drawing, the locker cavity 24 is provided at a side portion of the ignition cap 21 and positioned above the piezoelectric unit 13, wherein a guiding slot 241 is vertically provided on an rear wall 212 of the ignition cap 21 to communicate the locker cavity 24 with outside.

Figure 2:
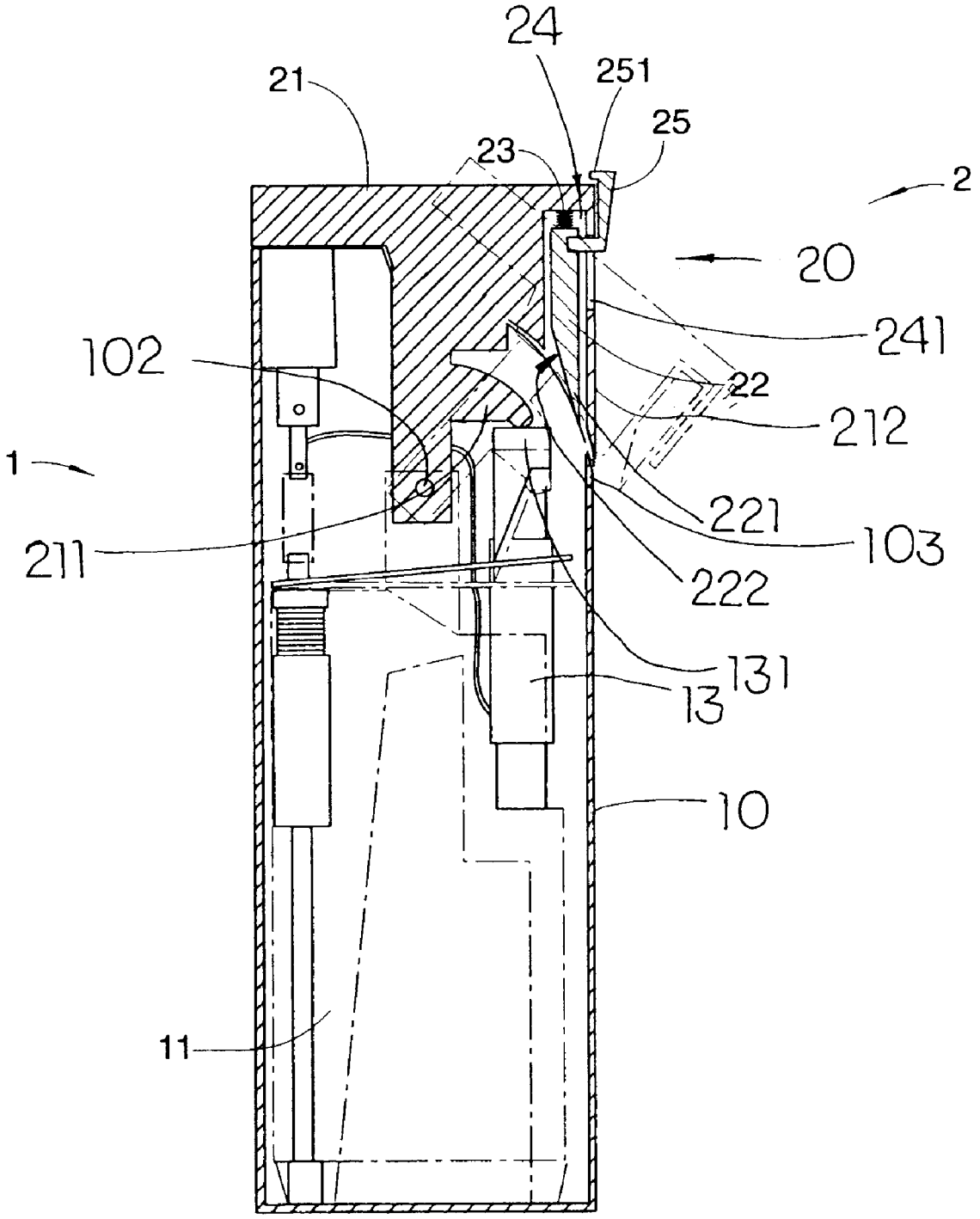
FIG. 2 is a partially sectional view of the piezoelectric lighter employed with the safety arrangement, during an unlocking condition, according to the above preferred embodiment of the present invention.

The locking member 20 comprises a locking latch 22 disposed in the locker cavity 24 and an operation button 25 extended from the locking latch 22 to outside through the guiding slot 241, wherein the locking latch 22 is movably fitted in the locker cavity 24 in such a manner that the locking latch 22 is arranged to be driven by the operation button 25 to move from a normally locking position (as shown in FIG. 1) to an unlocked position (as shown in FIG. 2).

The resilient element 23 which is disposed in the locker cavity 24 for applying an urging pressure against the locking member 22 so as to normally retain the locking member 22 at the locking position. In which, at the locking position, a locking portion 221 of the locking latch 22 is extended into the casing 10 for blocking up the ignition cap 21 from being slid sidewardly with respect to the casing 10 so as to lock up the ignition cap 21 from ignition. Also, at the unlocked position, the locking portion 221 of the locking latch 22 is moved away from the casing 10 so as to release the blocking up of the ignition cap 21 with respect to the casing 10, so that the ignition cap 21 is capable of being slid sidewardly to ignite the piezoelectric lighter 1.

According to the first preferred embodiment as shown in FIG. 1 to 3, the locking latch 22 is slidably fitted in the locker cavity 24 in a vertically movable manner and a bottom end of the locking latch 22 functioned as the locking portion 221. Also, the guiding slot 241 is an elongated slot provided on a rear wall 212 of the ignition cap 21. At normal locking position as shown in FIG. 1, the bottom end (locking portion) 221 of the locking member 22 is normally extended downwards into the casing 10 in order to block the ignition cap 21 from being radially moved sidewardly by an outer wall 103 of the casing 10. Moreover, the bottom end 221 of the locking latch 22 has a slope surface 222 for ensuring the locking latch 22 to slide back automatically to its original locking position.

Since when the ignition cap 21 is slid sidewardly, the bottom end 221 of the upwardly moved locking latch 22 will be pulled out of the casing 10 as well. When the ignition cap 21 is rebounded to its original locking position after ignition, the slope surface 222 at the bottom end 221 of the locking latch 22 will help the locking latch 22 slides back into the casing 10 along the outer wall 103.

According to the preferred embodiment of the present invention, the operation button 25 is integrally connected to a top end of the locking latch 22 through the guiding slot 241 provided on the rear wall 212 of the locker cavity 24, wherein the operation button 25 is adapted for sliding on the rear wall 212 along the guiding slot 241 while the locking latch 22 will be securely held in the locker cavity 24 in a vertically movable manner. In other words, the rear wall 212 of the ignition cap 21 is sandwiched between the locking latch 22 and the operation button 25 so as to secure the locking member 20 in a vertically movable manner.

As shown in FIG. 2, the guiding slot 241 has a predetermined length that the operation button 25 is pushed upwardly enough to move the locking latch 22 until its bottom end 221 is moved above the outer wall 103 of the casing 10 in purpose of unlocking the safety arrangement 2 of the piezoelectric lighter 1. Moreover, the operation button 25 has a lock tip 251 provided at a top end thereof towards the ignition cap 21. The lock tip 251 is arranged for hooking a top edge of the ignition cap 21 and holding the locking latch 22 in such an upper position so as to maintain the unlocking condition of the piezoelectric lighter 1.

The resilient element 23, according to the preferable embodiment of the present invention, is a compression spring which is disposed in the locker cavity 24 and is provided between the locking member 22 and a ceiling end of the locker cavity 24. The resilient element 23 has two ends biasing against the locking latch 22 and the ceiling end of the locker cavity 24. Accordingly, the resilient element 23 will normally urge and retain the locking member 22 in a lower position that the bottom end 221 of the locking latch 22 is extended into the casing 10 to block up the ignition cap 21 from being slid sidewardly from the casing 10, so as to lock up the ignition cap 21 from ignition.

Moreover, the safety arrangement 2 further comprises a holding means 30 for holding the resilient element 23 in the locker cavity 24 so as to secure the two ends of the resilient element 23 to bias against the locking latch 22 and the ceiling of the locker cavity 24. The holding means 30 comprises a first holding member 31 downwardly protruded from the ceiling of the locker cavity 24 and a second holding member 32 upwardly protruded from a top end of the locking latch 22, wherein the first holding member 31 and the second holding member 32 are adapted for engaging to the top and bottom ends of the resilient element 23 respectively. According to the first preferred embodiment of the present invention, the first and second holding means 31, 32, each having a rod-like shape, are adapted for inserting into the two ends of the resilient element 23 at its two ends thereof respectively.

Referring to FIG. 2 of the drawing, in order to ignite the piezoelectric lighter 1, a pushing force F1 is intentionally applied to push the operation button 25 of the locking member 20 vertically upward in order to lift the locking latch 22 out of the casing 10 to unlock the safety arrangement 2. For ladies, they may like to hook the lock tip 251 of the operation button 25 on the top edge of the ignition cap 21 to maintain the unlocking condition of the safety arrangement 2 so that it is easier for her to press the unlocked ignition cap 21. At this unlocked position, a sideward force F2 can be applied on the ignition cap 21 to compress the piezoelectric unit 13 for striking spark and ignite the piezoelectric lighter 1.

Since the force F2 is applied sidewardly, the lock tip 251 of the operation button 25 will be pulled out of the top edge of the ignition cap 21 and the locking member 20 will loss the retraction with the ignition cap 21. While releasing the sideward force F2 on the ignition cap 21, the compressed piezoelectric unit 13 will rebound to its original form which pushes the ignition cap 21 back to its original position. Furthermore, the slope surface 222 at the bottom end 221 of the locking latch 22 will slide along the top edge of the outer wall 103 of the casing 10 and back into the casing 10. The compressed resilient element 23 will then rebound downwardly and force the locking latch 22 remaining at its original lock-up position.

Figure 4:
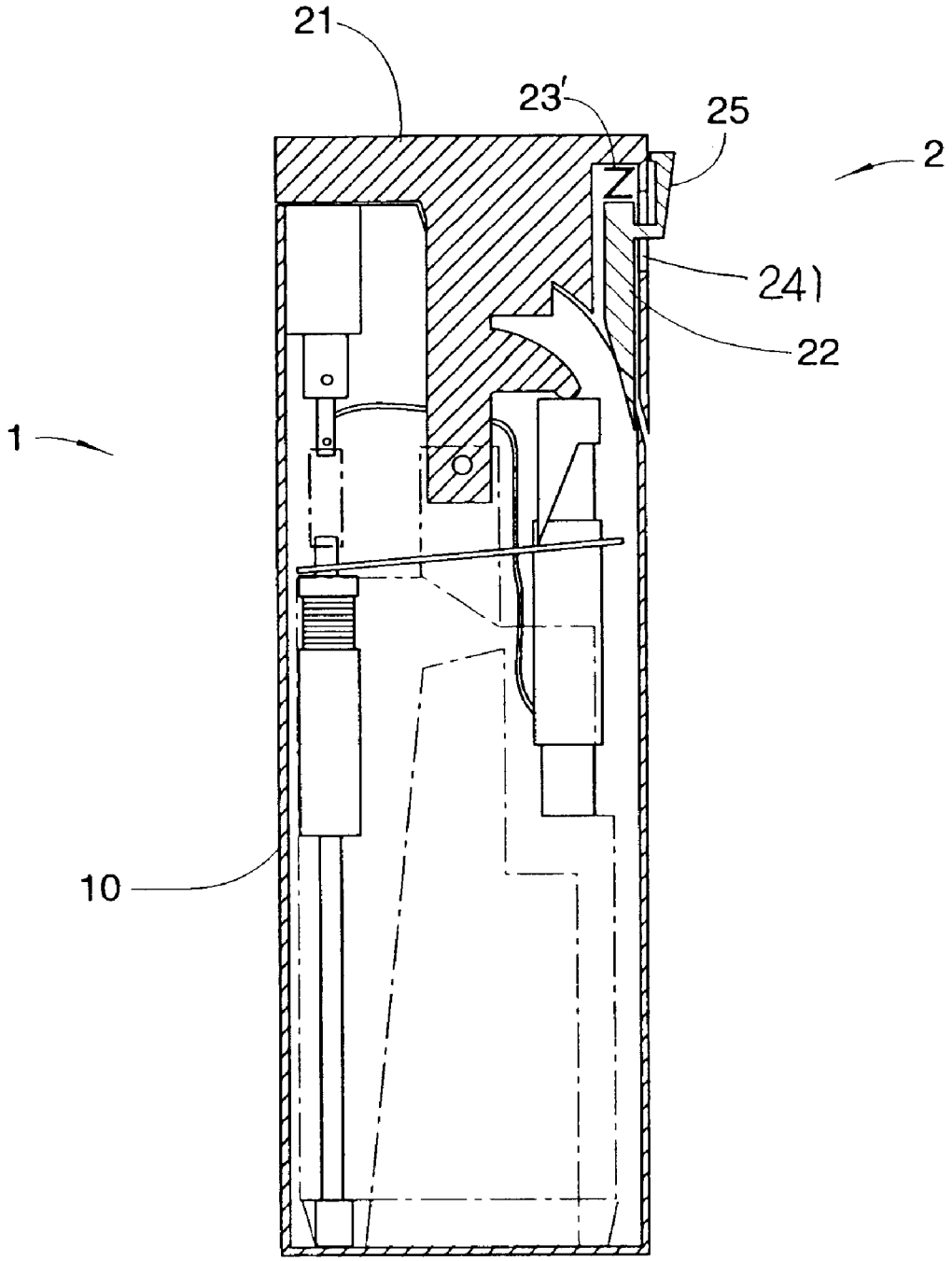
FIG. 4 is a partially sectional view of an alternative mode of the safety arrangement for piezoelectric lighter according to the above preferred embodiment of the present invention.

FIG. 4 illustrates an alternative mode of resilient element 23' of the preferred embodiment of the present invention, wherein a Z-shaped spring clip is substituted the spring wherein the Z-shaped spring clip has two ends biasing against the locking member 22 and the ceiling of the locker cavity 24. Thus, each end of the Z-shaped spring clip of the resilient element 23' has a receiving hole 40 wherein the first and second holding member 31, 32 of the holding means 30 are adapted for engaging to the receiving holes 40 of the resilient element 23' at its two ends thereof.

Figure 5:
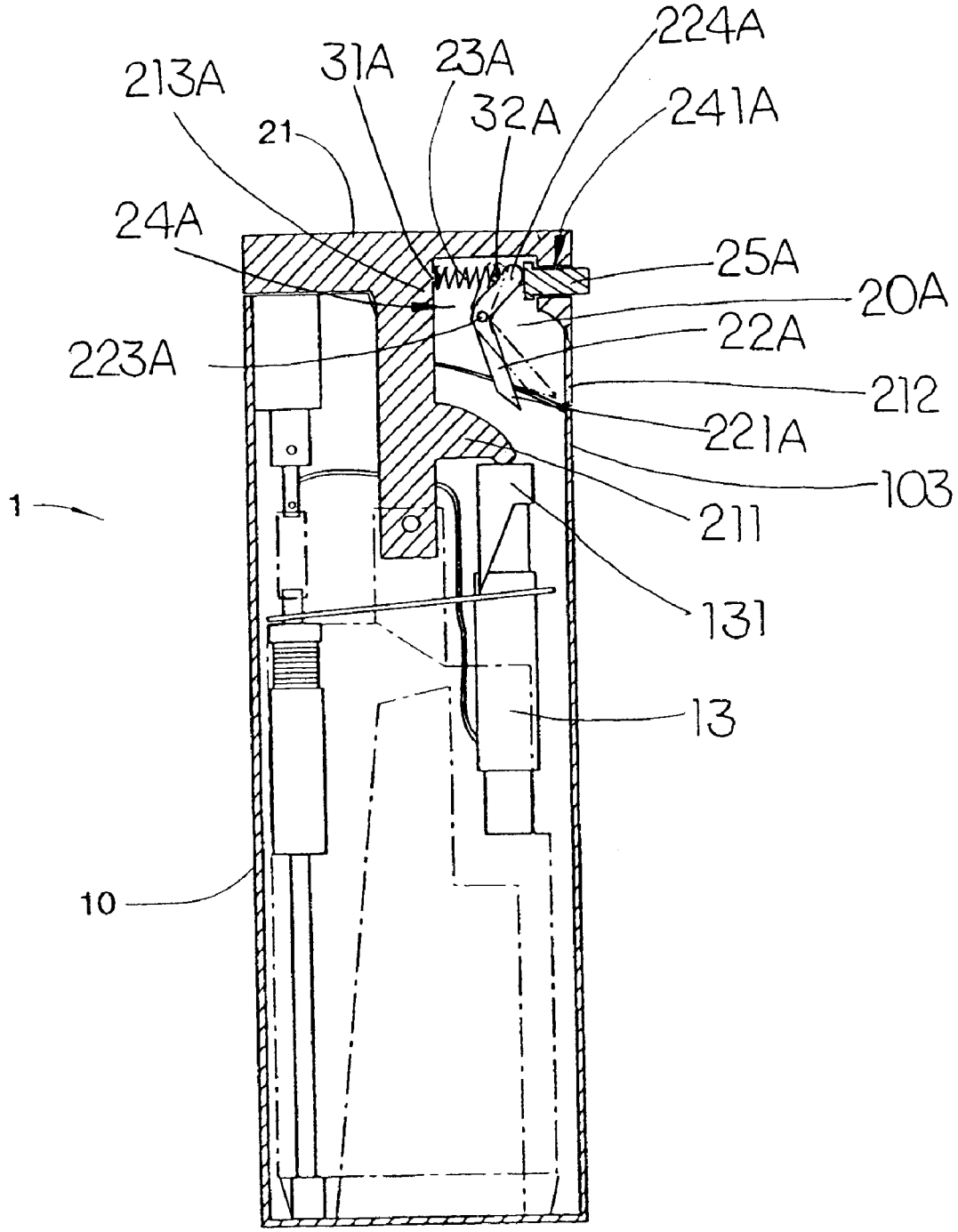
FIG. 5 is a partially sectional view of a piezoelectric lighter employed with a safety arrangement according to a second preferred embodiment of the present invention.

Referring to FIG. 5, a second preferred embodiment of the present invention illustrates an alternative mode of the above first embodiments. According to the second embodiment, the locking member 20A comprises a V-shaped modified locking latch 22A wherein a mid-tip of the V-shaped locking latch 22A is pivotally mounted in the locker cavity 24A by means of a pivot axle 223A in such manner that the locking latch 22A is normally maintained in a locking position that a bottom end (locking portion) 221A of the locking latch 22A is normally extended downwards into the casing 10 in order to block the ignition cap 21 from being radially moved sidewardly by an outer wall 103 of the casing 10.

The resilient element 23A is a compressive spring mounted between an upper half portion 224A of the locking latch 22A and an inner side wall 213A of the locker cavity 24A so as to apply an urging pressure against the upper half portion 224A of the locking latch 22A and to normally retain the bottom end 221A of the locking latch 22A at the locking position. Moreover, a first holding member 31A and a second holding member 32A are alternatively protruded from the inner side wall 213A of the locker cavity 24A and the upper half portion 224A of the locking latch 22A for securely holding the resilient element 23A between the first holding member 31A and the second holding member 32A.

The guiding slot 241A is in round hole shaped adapted to coaxially and slidably fit a round shaped operation button 25A therethrough, wherein an outer end of the operation button 25A is extended outside the ignition cap 21 through the guiding slot 241A and another inner end of the operation button 25A is extended inside the locker cavity 24A and press against the upper half portion 224A of the locking latch 22A.

Normally, at the locking position, the resilient element 23A presses the upper half portion 224A of the locking latch 22A towards the guiding slot 241A and then push the operation button 25A outwardly until the outer end thereof protruding from the ignition cap 21A.

To unlock the safety arrangement of the second embodiment as shown in FIG. 5, the user must pushes in the operation button 25A to press the upper half portion 224A of the locking latch 22A inwardly so as to pivotally rotate the bottom end 221A of the locking latch 22A upwards (as illustrated as phantom lines in FIG. 5) until it is out of the casing 10 and moves up to the unlocked position that the locking latch 22A is entirely disposed in the locker cavity 24A. Then, while maintaining the locking latch 22A in the locked position, simultaneously, the user may depress the ignition cap 21 downwards and sidewards to ignite the piezoelectric lighter 1.

In accordance with the preferred embodiment and its alternative mode as disclosed above, the piezoelectric lighter of the present invention can prevent the lighter to be unintentional ignited. No conventional piezoelectric lighter can provide a safety arrangement which sufficiently ensures any unintentional ignition of the piezoelectric lighter especially the ignition operation comprises a step of pushing the ignition cap sidewardly. The locking member of the safety arrangement will block the ignition cap in a radially movable manner in order to prevent the unintentional ignition. Furthermore, children are unable to ignite the lighter since they do not have sufficient power to compress the resilient and hook the operation button on the top edge of the ignition cap.

What is claimed is:

1. A piezoelectric lighter, comprising:

a casing receiving a liquefied gas storage;

a gas emitting nozzle in said casing and communicating with said liquefied gas storage for controlling a flow of gas;

a piezoelectric unit, which is disposed in said casing for generating piezoelectricity, comprising a movable operating part extended upwardly and an ignition tip extended to a position close to said gas emitting nozzle, wherein when said movable operating part is depressed downwardly, said ignition tip generates sparks to ignite said gas emitted from said gas emitting nozzle; and an ignition cap slidably mounted on said ceiling of said casing in a rotationally movable manner wherein said ignition cap is attached to a top end of said piezoelectric unit and arranged in such a manner that when said ignition cap is rotated sidewardly and downwardly at said same time, said movable operating part of said piezoelectric unit is depressed to ignite said piezoelectric lighter;

a safety arrangement, comprising:

a locker cavity provided at a side portion of said ignition cap and positioned above said piezoelectric unit, wherein a guiding slot is provided on said ignition cap to communicate said locker cavity with an exterior of said ignition cap;

a locking member comprising a locking latch disposed in said locker cavity and an operation button extended from said locking latch to said exterior through said guiding slot, wherein said locking latch is movably fitted in said locker cavity in such a manner that said locking latch is arranged to be driven by said operation button to move from a normally locked position to an unlocked position; and a resilient element which is disposed in said locker cavity for applying an urging pressure against said locking member so as to normally retain said locking member in said locked position, wherein at said locking position, a locking portion of said locking latch is extended into said casing for blocking up said ignition cap from being slid sidewardly with respect to said casing, so as to lock up said ignition cap from ignition, and that in said unlocked position, said locking portion of said locking latch is moved away from said casing so as to release said blocking up of said ignition cap with respect to said casing, so that said ignition cap is capable of being slid sidewardly to ignite said piezoelectric lighter.

2. The piezoelectric lighter, as recited in claim 1, wherein said locking latch is slidably fitted in said locker cavity in a vertically movable manner and said guiding slot is an elongated slot vertically provided on a rear wall of said ignition cap, wherein said resilient element is provided between said locking member and a top end of said locker cavity for urging and retaining said locking member in a lower position such that a bottom end of said locking latch extends into said casing for blocking up said ignition cap from being slid sidewardly from said casing so as to lock up said ignition cap from ignition, wherein said operation button is arranged for sliding on said rear wall along said guiding slot and is capable of pushing upwardly enough to move said locking latch out of said casing in order to unlock said safety arrangement of said piezoelectric lighter.

3. The piezoelectric lighter, as recited in claim 2, wherein said bottom end of said locking latch has a sloped surface for ensuring said locking latch to slide back automatically to an original locking position thereof, wherein when said ignition cap is slid sidewardly, said bottom end of said locking latch is pulled out of said casing as well, moreover when said ignition cap is rebounded to an original locked position thereof after ignition, said slope surface at said bottom end of said locking latch, which urges against an outer wall of said casing, compresses said resilient element and guides said locking latch to slide back into said casing along said outer wall of said casing.

4. The piezoelectric lighter, as recited in claim 3, wherein said operation button is integrally connected to a top end of said locking latch through said guiding slot provided on said rear wall of said locker cavity, wherein said operation button is adapted for sliding on said rear wall along said guiding slot while said locking latch is securely held in said locker cavity in a vertically movable manner.

5. The piezoelectric lighter, as recited in claim 4, wherein said operation button has a lock tip provided at a top end thereof towards said ignition cap, said lock tip being arranged for hooking a top edge of said ignition cap and holding said locking latch in such an upper position so as to maintain said unlocked condition of said piezoelectric lighter.

6. The piezoelectric lighter, as recited in claim 3, wherein said operation button has a lock tip provided at a top end thereof towards said ignition cap, said lock tip being arranged for hooking a top edge of said ignition cap and holding said locking latch in such an upper position so as to maintain said unlocked condition of said piezoelectric lighter.

7. The piezoelectric lighter, as recited in claim 3, wherein said safety arrangement further comprises a first holding member downwardly protruded from said ceiling of said locker cavity and a second holding member upwardly protruded from a top end of said locking latch, wherein said first holding member and said second holding member are engaged with a top end and a bottom end of said resilient element respectively, so as to firmly and axially hold said resilient element in a vertical position.

8. The piezoelectric lighter, as recited in claim 7, wherein said resilient element is a compressive spring.

9. The piezoelectric lighter, as recited in claim 2, wherein said operation button is integrally connected to a top end of said locking latch through said guiding slot provided on said rear wall of said locker cavity, wherein said operation button is adapted for sliding on said rear wall along said guiding slot while said locking latch is securely held in said locker cavity in a vertically movable manner.

10. The piezoelectric lighter, as recited in claim 9, wherein said operation button has a lock tip provided at a top end thereof towards said ignition cap, said lock tip being arranged for hooking a top edge of said ignition cap and holding said locking latch in such an upper position so as to maintain said unlocked condition of said piezoelectric lighter.

11. The piezoelectric lighter, as recited in claim 2, wherein said operation button has a lock tip provided at a top end thereof towards said ignition cap, said lock tip being arranged for hooking a top edge of said ignition cap and holding said locking latch in such an upper position so as to maintain said unlocked condition of said piezoelectric lighter.

12. The piezoelectric lighter, as recited in claim 1, wherein said bottom end of said locking latch has a sloped surface for ensuring said locking latch to slide back automatically to an original locking position thereof, wherein when said ignition cap is slid sidewardly, said bottom end of said locking latch is pulled out of said casing as well, moreover when said ignition cap is rebounded to an original locked position thereof after ignition, said slope surface at said bottom end of said locking latch, which urges against an outer wall of said casing, compresses said resilient element and guides said locking latch to slide back into said casing along said outer wall of said casing.

13. The piezoelectric lighter, as recited in claim 12, wherein said operation button is integrally connected to a top end of said locking latch through said guiding slot provided on said rear wall of said locker cavity, wherein said operation button is adapted for sliding on said rear wall along said guiding slot while said locking latch is securely held in said locker cavity in a vertically movable manner.

14. The piezoelectric lighter, as recited in claim 13, wherein said operation button has a lock tip provided at a top end thereof towards said ignition cap, said lock tip being arranged for hooking a top edge of said ignition cap and holding said locking latch in such an upper position so as to maintain said unlocked condition of said piezoelectric lighter.

15. The piezoelectric lighter, as recited in claim 12, wherein said operation button has a lock tip provided at a top end thereof towards said ignition cap, said lock tip being arranged for hooking a top edge of said ignition cap and holding said locking latch in such an upper position so as to maintain said unlocked condition of said piezoelectric lighter.

16. The piezoelectric lighter, as recited in claim 1, wherein said operation button has a lock tip provided at a top end thereof towards said ignition cap, said lock tip being arranged for hooking a top edge of said ignition cap and holding said locking latch in such an upper position so as to maintain said unlocked condition of said piezoelectric lighter.

17. The piezoelectric lighter, as recited in claim 1, wherein said safety arrangement further comprises a first holding member downwardly protruded from said ceiling of said locker cavity and a second holding member upwardly protruded from a top end of said locking latch, wherein said first holding member and said second holding member are engaged with a top end and a bottom end of said resilient element respectively, so as to firmly and axially hold said resilient element in a vertical position.

18. The piezoelectric lighter, as recited in claim 17, wherein said resilient element is a compressive spring.

19. The piezoelectric lighter, as recited in claim 1, wherein said resilient element is a compressive spring.

20. The piezoelectric lighter, as recited in claim 1, wherein said resilient element is a Z-shaped spring clip.

21. The piezoelectric lighter, as recited in claim 1, wherein said locking member comprises a V-shaped locking latch having a mid-tip pivotally mounted in said locker cavity in such a manner that said locking latch is normally maintained in a locked position and that a bottom end of said locking latch normally extends downwards into said casing in order to block said ignition cap from being rotated moved sidewardly by an outer wall of said casing.

22. The piezoelectric lighter, as recited in claim 21, wherein said resilient element is a compressive spring mounted between an upper half portion of said locking latch and an inner side wall of said locker cavity so as to apply an urging pressure against said upper half portion of said locking latch and to normally retain said bottom end of said locking latch at said locking position.

23. The piezoelectric lighter, as recited in claim 22, wherein a first holding member and a second holding member are alternatively protruded from said inner side wall of said locker cavity and said upper half portion of said locking latch for securely holding said resilient element between said first holding member and said second holding member.

24. The piezoelectric lighter, as recited in claim 23, wherein said operation button is round shaped and said guiding slot is in a round hole shaped and adapted to coaxially and slidably fit said operation button therethrough, wherein an outer end of said operation button extends outside said ignition cap through said guiding slot and another inner end of said operation button extends inside said locker cavity and presses against said upper half portion of said locking latch, wherein in said locked position, said resilient element presses said upper half portion of said locking latch towards said guiding slot and then pushes said operation button outwardly until said outer end thereof protrudes from said ignition cap.

25. The piezoelectric lighter, as recited in claim 22, wherein said operation button is round shaped and said guiding slot is in a round hole shaped and adapted to coaxially and slidably fit said operation button therethrough, wherein an outer end of said operation button extends outside said ignition cap through said guiding slot and another inner end of said operation button extends inside said locker cavity and presses against said upper half portion of said locking latch, wherein in said locked position, said resilient element presses said upper half portion of said locking latch towards said guiding slot and then pushes said operation button outwardly until said outer end thereof protrudes from said ignition cap.

* * * * *